US006836264B2

(12) United States Patent
Shih

(10) Patent No.: US 6,836,264 B2
(45) Date of Patent: Dec. 28, 2004

(54) DRIVING CIRCUIT OF DISPLAY

(75) Inventor: Li-Wei Shih, Chiai (TW)

(73) Assignee: Au Optronics Corporation, Hsinchu (TW)

( * ) Notice: Subject to any disclaimer, the term of this patent is extended or adjusted under 35 U.S.C. 154(b) by 315 days.

(21) Appl. No.: 10/247,665

(22) Filed: Sep. 18, 2002

(65) Prior Publication Data

US 2004/0004589 A1 Jan. 8, 2004

(30) Foreign Application Priority Data

Jul. 4, 2002 (TW) ..... 91114785 A

(51) Int. Cl.[7] ..... G09G 3/32

(52) U.S. Cl. ..... 345/82; 345/82; 345/204

(58) Field of Search ..... 345/75–80, 82, 345/84, 90–92, 98, 204, 205, 207, 697

(56) References Cited

U.S. PATENT DOCUMENTS 6,661,397 B2 * 12/2003 Mikami et al. ..... 345/82
6,677,713 B1 * 1/2004 Sung ..... 345/204
6,778,151 B2 * 8/2004 Li ..... 345/82
2002/0196213 A1 * 12/2002 Akimoto et al. ..... 345/82

* cited by examiner

*Primary Examiner*—Bipin Shalwala
*Assistant Examiner*—Laurel E. LeFlore
(74) *Attorney, Agent, or Firm*—J. C. Patents

(57) ABSTRACT

A driving circuit of display. Two more thin film transistors is added to the original driving circuit of display so that the driving circuit now includes four thin film transistors such that the gate terminal of the thin film transistor's voltage level increases as the threshold voltage of the driving thin film transistor increases. The driving current of the thin film transistor is able to maintain a constant value so that the initial luminance of the display remains unchanged. Therefore, the present invention can effectively increase the average working life of the display.

23 Claims, 2 Drawing Sheets

DRIVING CIRCUIT OF DISPLAY

CROSS-REFERENCE TO RELATED APPLICATION

This application claims the priority benefit of Taiwan application serial no. 91114785, filed Jul. 4, 2002.

BACKGROUND OF THE INVENTION

1. Field of Invention

The present invention relates to the driving circuit of a display. More particularly, the present invention relates to a driving circuit capable of maintaining a constant driving current in a display.

2. Description of Related Art

People are always interested in watching recorded images and movies. Since the invention of the cathode ray tube (CRT), televisions have become commercialized and owned by almost every family. Accompanying the rapid progress in technology, the CRT has been used in many applications including the desktop monitor of a personal computer. However, the CRT poses a radiation hazard and due to the bulkiness of the electron gun, the CRT display is hard to lighten up and flatten.

Because of intrinsic bulkiness, researchers are now developing more slim-line displays. The so-called 'flat panel displays' now include liquid crystal displays (LCDs), field emission displays (FEDs), organic light-emitting diode (OLED) displays and plasma display panel (PDP) displays.

The organic light-emitting diode (OLED) is also known as an organic electroluminescence display (OELD) due to its self-illuminating character. OLED is driven by a low DC voltage and has properties including high brightness level, high energy efficiency, high contrast values as well as being slim and lightweight. Moreover, the display is able to emit light of a range of colors from the three primary colors red (R), green (G) and blue (B) to white light. Hence, OLED is considered to be the display panel of the next generation. Aside from having high resolution and light just like the LCD and having self-illuminating capacity, a quick response and a low energy consumption just like the LED, OLED also has other advantages including a wide viewing angle, good color contrast and a low production cost. Thus, OLED is often used in LCD or as a background light source for indicator panels, mobile phone, digital cameras and personal digital assistant (PDA).

According to the type of driver selected to drive the OLED, OLED can be divided into passive matrix driven or active matrix driven type. Passive matrix OLED has the advantage of structural simplicity. It does not have to be driven by a thin film transistor (TFT) and hence has a lower production cost. However, the passive matrix OLED has a relative low resolution rendering it unsuitable for producing high-quality images. Moreover, the passive matrix OLED consumes a lot of power, has a shorter working life and sub-optimal displaying capacity. On the other hand, although the active matrix OLED is slightly more expensive to produce, it can be assembled to form a huge screen aside from having a large viewing angle, the capacity for producing high brightness level and a quick response.

According to the driving method, a flat display panel is also divided into voltage-driven type or a current-driven type. In general, the voltage-driven type is employed in TFT-LCD. By inputting different voltages to the data lines, different shades of gray are produced to generate a full color palette. Voltage-driven TFT-LCD is technically mature, stable and cost-effective to produce. The current-driven type is mainly employed in OLED display. To operate the current-driven flat display panel, different currents are fed into data lines to produce different shades of gray for generating a full color palette. Since new types of circuits and ICs must be developed to drive the current-driven pixels, development cost for this type of panel is huge. Thus, if TFT-LCD voltage-driven circuit can somehow be tapped to drive the OLED, production cost will be greatly reduced. However, if the TFT-LCD voltage-driven circuit is deployed to drive the OLED, threshold voltage of the driving TFT may shift after a long period of operation leading to a rise in the threshold voltage. The drain current of TFT in the saturation region is given by the formula:

$$I_{ds}=(1/2)\times\mu_n\times C_{ox}\times(W/L)\times(V_{gs}-V_{th})^2$$

Here, electron mobility $\mu_n$ and gate capacitor on unit area $C_{ox}$ are constants, $V_{th}$ is the threshold voltage of the TFT, W is the channel width of the TFT and L is the channel length of the TFT. According to the aforementioned formula, a rise in the threshold voltage leads to a lowering of the driving current flowing between the drain terminal and source terminal of the driving TFT. Since the driving current is used to drive the OLED and produce light, a lowering of the driving current results in a dimming of the OLED emission.

To provide a better explanation refer to the circuit in FIG. 1. FIG. 1 is a diagram showing the circuit of a pixel 10 in a conventional display. As shown in FIG. 1, the pixel 10 circuit includes a conventional driving circuit 102 and an OLED (104). The aforementioned driving circuit 102 further includes a TFT1 (106), a capacitor C (108) and a TFT2 (110). TFT2 (110) is a driving thin film transistor that generates a driving current for driving the OLED (104) and producing light. The drain terminal of TFT1 (106) is coupled to a data voltage ($V_{data}$). The gate terminal of TFT1 (106) is coupled to a scanning voltage ($V_{scan}$). The source terminal of TFT1 (106) is coupled to a first terminal of the capacitor C (108) and the gate terminal of TFT2 (110). The drain terminal of TFT2 (110) is coupled to a positive voltage ($V_{dd}$) terminal. The source terminal of TFT2 (110) is coupled to the positive terminal of the OLED (104). The second terminal of the capacitor C (108) is coupled to a voltage ($V_{ss1}$) terminal. $V_{ss1}$ is a negative voltage or a ground voltage. The negative terminal of the OLED (104) is coupled to a voltage ($V_{ss}$) terminal. The voltage $V_{ss}$ is a negative voltage or a ground voltage.

FIG. 2 is a timing diagram showing the variation of $V_{dd}$, $V_{scan}$, $V_{data}$, $V_{g2}$ of the gate terminal of TFT2 (110) in the driving circuit 102 in FIG. 1. As shown in FIG. 2, when $V_{scan}$ is set to a high potential, TFT1 (104) will conduct. When $V_{scan}$ is set to a low potential, TFT1 (104) will shut down. In addition, the interval between the appearance of a high potential and a low potential is called a frame period (indicated by T in FIG. 2). In general, a frame period is 1/60 second. In other words, the driving circuit 102 operates at a 60 Hz frequency and one frame constitutes a pixel of image. Since $V_{data}$ is at a high potential when $V_{scan}$ is at a high potential, $V_{g2}$ maintains a positive voltage and rises gradually. The gradual rising of $V_{g2}$ leads to the accumulation of more trap charges in the oxide layer at the gate terminal of TFT2 (110). Consequently, there is a shift in the threshold voltage of TFT2 (110) towards a higher voltage. As a result, there is a lowering of driving current from the drain terminal to the source terminal of TFT2 (110) and a corresponding reduction in the brightness level of the OLED (104).

SUMMARY OF THE INVENTION

Accordingly, one object of the present invention is to provide a driving circuit for a display. Two thin film transistors are added to the original driving circuit of display so that the driving circuit now includes four thin film transistors such that the gate terminal of the thin film transistor's voltage level increases as the threshold voltage of the driving thin film transistor increases. Therefore, the driving current of the thin film transistor is able to maintain a constant value and hence the initial luminance of the display remains unchanged.

To achieve these and other advantages and in accordance with the purpose of the invention, as embodied and broadly described herein, the invention provides a driving circuit for a display. The driving circuit is used for driving a light-emitting device. The light-emitting device has a positive terminal and a negative terminal. The driving circuit includes a first transistor, a capacitor, a second transistor, a third transistor and a fourth transistor. The first transistor has a drain terminal, a gate terminal and a source terminal. The drain terminal of the first transistor is coupled to an inverted data voltage terminal. The gate terminal of the first transistor is coupled to a scanning voltage terminal. The capacitor has a first terminal and a second terminal. The first terminal of the capacitor is coupled to the source terminal of the first transistor and the second terminal of the capacitor is coupled to a first voltage. The second transistor has a drain terminal, a gate terminal and s source terminal. The gate terminal of the second transistor is coupled to the source terminal of the first transistor and the first terminal of the capacitor. The source terminal of the second transistor is coupled to the first voltage. The third transistor has a drain terminal, a gate terminal and a source terminal. The drain terminal of the third transistor is coupled to gate terminal of the third transistor and a second voltage. The source terminal of the third transistor is coupled to the drain terminal of the second transistor. The fourth transistor has a drain terminal, a gate terminal and a source terminal. The drain terminal of the fourth transistor is coupled to a third voltage and the gate terminal of the fourth transistor is coupled to the drain terminal of the second transistor and the source terminal of the third transistor. The source terminal of the fourth transistor is coupled to the positive terminal of the light-emitting device.

In one preferred embodiment of this invention, channel width/channel length ratio of the second transistor is four times the channel width/channel length ratio of the channel of the third transistor.

In one preferred embodiment of this invention, the first transistor, the second transistor, the third transistor and the fourth transistor are all n-type amorphous silicon thin film transistors.

In one preferred embodiment of this invention, the first voltage is a negative voltage or a ground voltage.

In one preferred embodiment of this invention, the second voltage and the third voltage are positive voltages.

In one preferred embodiment of this invention, the negative terminal of the light-emitting device is coupled to a fourth voltage such that the fourth voltage is a negative voltage or a ground potential.

In one preferred embodiment of this invention, the light-emitting device is an organic light-emitting diode or a polymeric light-emitting diode.

This invention also provides a display that includes a plurality of pixels. Each pixel includes a first transistor, a capacitor, a second transistor, a third transistor, a fourth transistor and a light-emitting device. The first transistor has a drain terminal, a gate terminal and a source terminal. The drain terminal of the first transistor is coupled to an inverted data voltage terminal. The gate terminal of the first transistor is coupled to a scanning voltage terminal. The capacitor has a first terminal and a second terminal. The first terminal of the capacitor is coupled to the source terminal of the first transistor and the second terminal of the capacitor is coupled to a first voltage. The second transistor has a drain terminal, a gate terminal and source terminal. The gate terminal of the second transistor is coupled to the source terminal of the first transistor and the first terminal of the capacitor. The source terminal of the second transistor is coupled to the first voltage. The third transistor has a drain terminal, a gate terminal and a source terminal. The drain terminal of the third transistor is coupled to gate terminal of the third transistor and a second voltage. The source terminal of the third transistor is coupled to the drain terminal of the second transistor. The fourth transistor has a drain terminal, a gate terminal and a source terminal. The drain terminal of the fourth transistor is coupled to a third voltage and the gate terminal of the fourth transistor is coupled to the drain terminal of the second transistor and the source terminal of the third transistor. The light-emitting diode has a positive terminal and a negative terminal. The positive terminal of the light-emitting device is coupled to the source terminal of the fourth transistor.

In one preferred embodiment of this invention, channel width/channel length ratio of the second transistor is four times the channel width/channel length ratio of the channel of the third transistor.

In one preferred embodiment of this invention, the first transistor, the second transistor, the third transistor and the fourth transistor are all n-type amorphous silicon thin film transistors.

In one preferred embodiment of this invention, the first voltage is a negative voltage or a ground voltage.

In one preferred embodiment of this invention, the second voltage and the third voltage are positive voltage.

In one preferred embodiment of this invention, the negative terminal of the light-emitting device is coupled to a fourth voltage such that the fourth voltage is a negative voltage or a ground potential.

In one preferred embodiment of this invention, the light-emitting device is an organic light-emitting diode or a polymeric light-emitting diode.

In brief, this invention incorporates two more thin film transistors to the original driving circuit of display. The driving circuit now includes four thin film transistors such that the gate terminal of the thin film transistor's voltage level increases as the threshold voltage of the driving thin film transistor increases. The driving current of the thin film transistor is able to maintain a constant value so that the initial luminance of the display remains unchanged. Ultimately, this invention effectively increases the average working life of the display.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
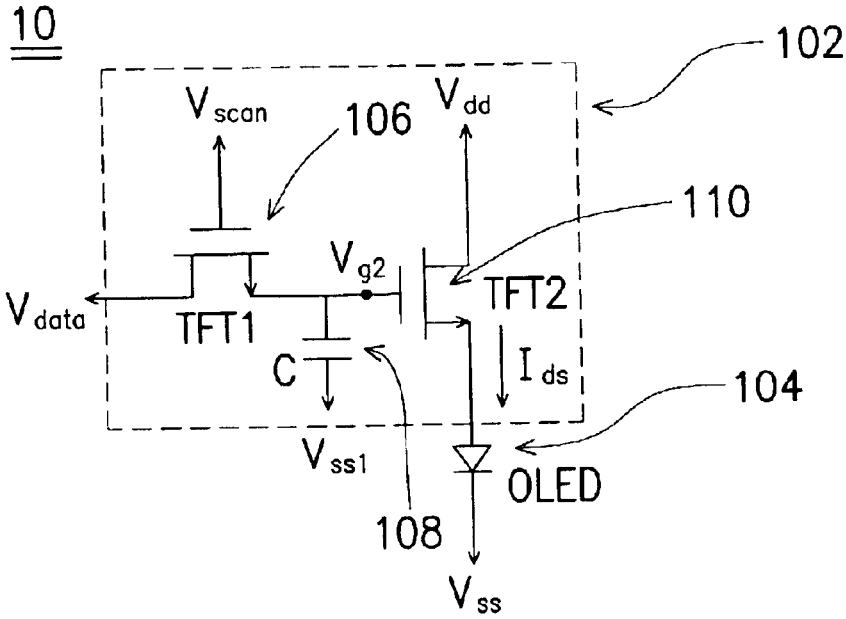
FIG. 1 (PRIOR ART)
FIG. 1 is a diagram showing the circuit of a pixel in a conventional display.
Figure 2:
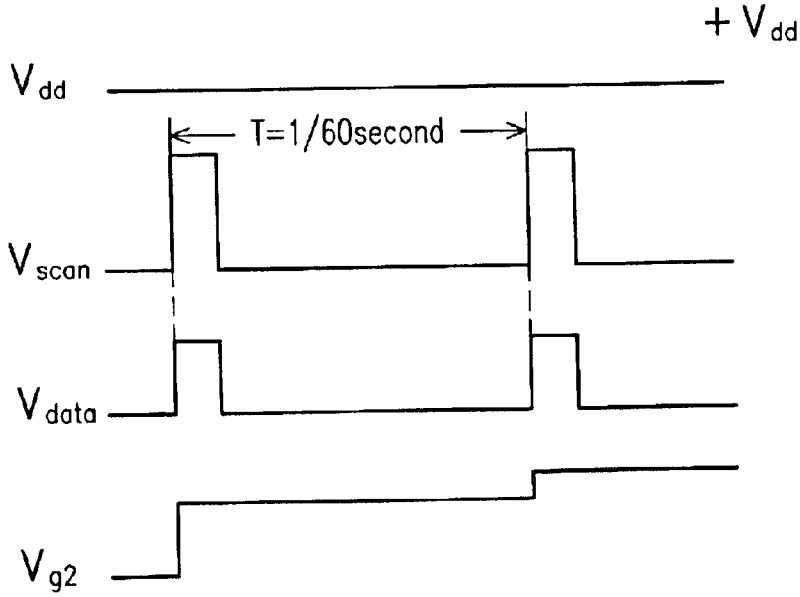
FIG. 2 (PRIOR ART)
FIG. 2 is a timing diagram showing the variation of voltages $V_{dd}$, $V_{scan}$, $V_{data}$, $V_{g2}$ in a conventional driving circuit.

Reference will now be made in detail to the present preferred embodiments of the invention, examples of which are illustrated in the accompanying drawings. Wherever possible, the same reference numbers are used in the drawings and the description to refer to the same or like parts.

Figure 3:
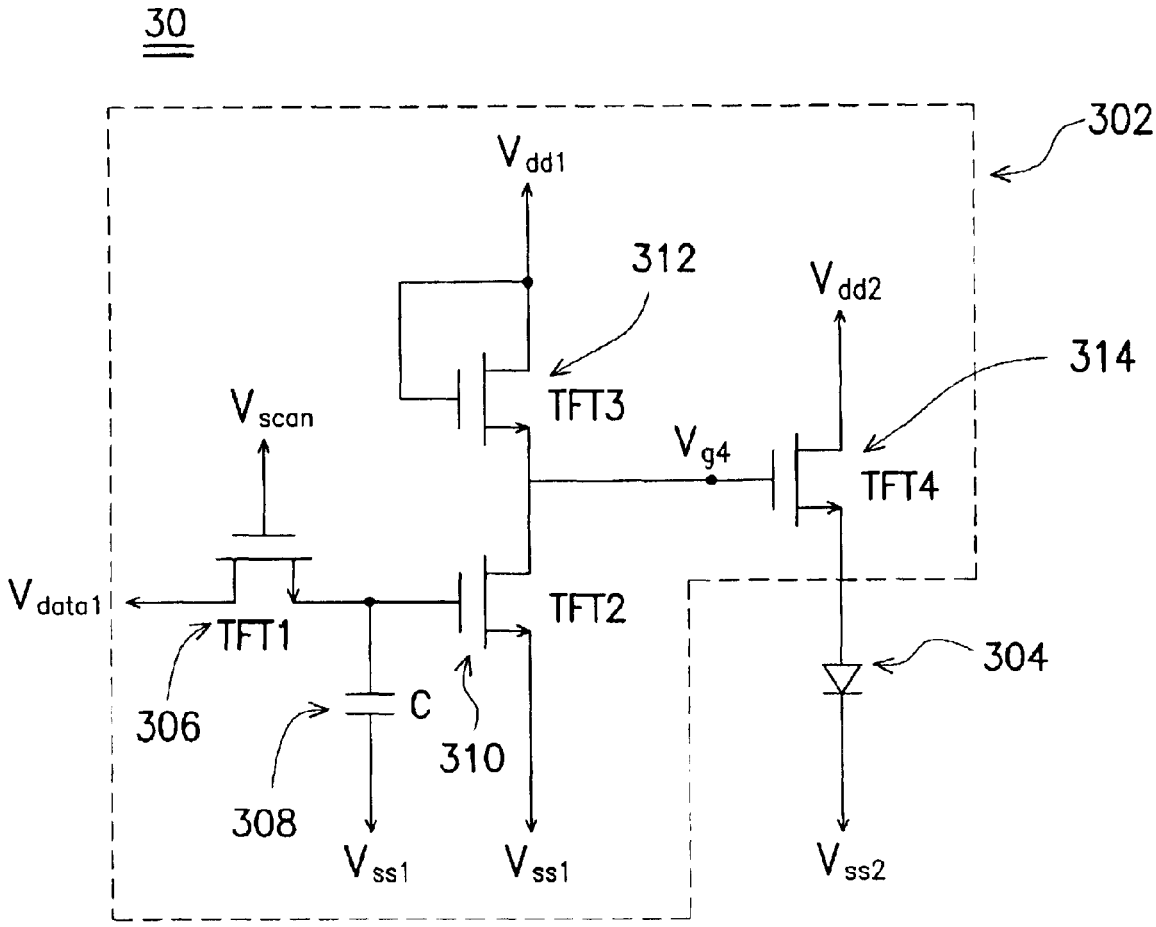
FIG. 3 is a diagram showing the circuit of a pixel in a display according to one preferred embodiment of this invention.

FIG. 3 is a diagram showing the circuit of a pixel 30 in a display according to one preferred embodiment of this invention. The pixel 30 includes a driving circuit 302 and a light-emitting device 304. The light-emitting device 304 can be an organic light-emitting diode (OLED) or a polymeric light-emitting diode. The driving circuit 302 further includes a thin film transistor TFT1 (306), a capacitor C (308), a second thin film transistor TFT2 (310), a third thin film transistor TFT3 (312) and a fourth thin film transistor TFT4 (314). The fourth thin film transistor TFT4 (314) known also as a driving thin film transistor is used for generating a driving current that drives the light-emitting device 304 and produces light. The channel width/channel length ratio of the second thin film transistor TFT2 (310) is four times the channel width/channel length ratio of the third thin film transistor TFT3 (312). Note that all the thin film transistors including TFT1 (306), TFT2 (310), TFT3 (312) and TFT4 (314) are n-type amorphous silicon thin film transistors (α-Si TFT). Since all amorphous thin film transistors have almost identical threshold voltage, the threshold voltages $V_{th1}$, $V_{th2}$, Vth3, $V_{th4}$ of the transistors TFT1 (306), TFT2 (310), TFT3 (312), TFT4 (314) are assumed to be identical. The following is a description of various structural components in the voltage-driving circuit 302.

The drain terminal of TFT1 (306) is coupled to an inverted data voltage ($V_{data1}$) terminal and the gate terminal of TFT1 (306) is coupled to a scan voltage ($V_{scan}$) terminal. The source terminal of TFT1 (306) is coupled to a first terminal of the capacitor (308) and the gate terminal of the TFT2 (310). The inverted data voltage ($V_{data1}$) is an inverted voltage of the data voltage ($V_{data}$) in FIG. 1 because TFT2 (310) and TFT3 (312) is an inverter group. To maintain the voltage at the gate terminal of TFT4 (314) at the same high or low potential as the gate terminal of the thin film transistor TFT2 (110) in FIG. 1, the inverted data voltage ($V_{data1}$) must be an inversion of the data voltage ($V_{data}$). The second terminal of the capacitor (108) is coupled to a voltage ($V_{ss1}$) terminal. The voltage $V_{ss1}$ is a negative voltage or a ground potential. The drain terminal of TFT2 (310) is coupled to the source terminal of TFT3 (312) and the gate terminal of TFT4 (314). The source terminal of TFT2 (310) is coupled to the voltage $V_{ss1}$ terminal. The drain terminal of TFT3 (312) is coupled to the gate terminal of TFT3 (312) and a positive voltage ($V_{dd1}$) terminal. The source terminal of TFT4 (314) is coupled to a positive voltage ($V_{dd2}$) terminal. The source terminal of TFT4 (314) is coupled to the positive terminal of the light-emitting device (304). The negative terminal of the light-emitting device (304) is coupled to a voltage ($V_{ss2}$) terminal. The voltage $V_{ss2}$ is a negative voltage or a ground potential.

After the driving circuit in FIG. 1 is used for some time, threshold voltage of TFT2 (110) may rise due to the accumulation of charges. With the introduction of thin film transistors TFT2 (310) and TFT3 (312) into the driving circuit of FIG. 1, potential at the gate terminal of TFT4 (314) will increase with the increase in threshold voltage of TFT4 (314). With the driving current at a constant level, the original luminance of the light-emitting device (304) is maintained. The following is a more detailed description of how to maintain the driving current of TFT4 (314) at a constant value.

When voltage $V_{scan}$ is set to a high potential, TFT1 (306) will conduct and the gate of TFT2 (310) will have a voltage $V_{data1}$. Because the current flowing through TFT2 (310) and TFT3 (312) is identical, according to the drain current formula for TFT operating in a saturated region:

$$(1/2)\times\mu_n\times C_{ox}\times(W/L)^2\times(V_{data1}-V_{ss1}-V_{th2})^2=(1/2)\times\mu_n\times C_{ox}\times(W/L)^3\times(V_{dd1}-V_{g4}-V_{th3})^2 \quad (1);$$

here, the electron mobility $\mu_n$ and unit area gate capacitance $C_{ox}$ are constants, $(W/L)^2$ is the channel width/channel length ratio of TFT2 (310), $(W/L)^3$ is the channel width/channel length ratio of TFT3 (312), $V_{g4}$ is the gate potential of TFT4 (314). Since $V_{th2}=V_{th3}=V_{th4}$ is already assumed and that $(W/L)^2=4(W/L)^3$, $V_{g4}=V_{dd1}+2V_{ss1}-2V_{data1}+V_{th4}=\text{constant}-2V_{data1}+V_{th4}$ according to formula (1). Since the driving current of TFT4 (314) is given by the formula:

$$I_{ds4}=(1/2)\times\mu_n\times C_{ox}(W/L)^4\times(V_{g4}-V_{s4}-V_{th4})^2=K\times(V_{g4}-V_{s4}-V_{th4})^2;$$

where $V_{s4}$ is the source voltage of TFT4 (314) and K is a constant. Hence, by incorporating $Vg_4=\text{constant}-2V_{data1}+V_{th4}$, the driving current of TFT4 (314) is given by the formula:

$$I_{ds4}=K\times(constant-2V_{data1}-V_{s4})^2$$

because the factor $V_{th4}$ in $I_{ds4}$ can be ignored. Thus, $I_{ds4}$ is a constant unaffected by any change in $V_{th4}$. Since luminance of the light-emitting diode 302 remains at the original value due to the constancy of $I_{ds4}$, the working life of the display is longer.

In conclusion, this invention incorporates two more thin film transistors to the original driving circuit of display so that the driving circuit now includes four thin film transistors. The gate terminal of the thin film transistor's voltage level increases as the threshold voltage of the driving thin film transistor increases so that the driving current of the thin film transistor is able to maintain a constant value so that the initial luminance of the display remains unchanged. Therefore, this invention effectively increases the average working life of the display.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving circuit of a display for driving a light-emitting device having a positive terminal and a negative terminal, the driving circuit comprising: a first transistor having a drain terminal, a gate terminal and a source terminal, wherein the drain terminal of the tirst transistor is coupled to an inverted data voltage line and the gate terminal of the first transistor is coupled to a scanning voltage line; a capacitor having a first terminal and a second terminal, wherein the first terminal of the capacitor is coupled to the source terminal of the first transistor and the second terminal of the capacitor is coupled to a first voltage line; a second transistor having a drain terminal, a gate terminal and a source terminal, wherein the gate terminal of the second transistor is coupled to the source terminal of the first transistor and the first terminal of the capacitor, and the source terminal of the second transistor is coupled to the first voltage line; a third transistor having a drain terminal, a gate terminal and a source terminal, wherein the drain terminal of the third transistor is coupled to the gate terminal of the third transistor and a second voltage line, and the source terminal of the third transistor is coupled to the drain terminal of the second transistor; and a fourth transistor having a drain terminal, a gate terminal and a source terminal, wherein the drain terminal of the fourth transistor is coupled to a third voltage line, the gate terminal of the fourth terminal is coupled to the drain terminal of the second transistor, and the source terminal of the fourth transistor is coupled to the positive terminal of the light-emitting device.

2. The driving circuit of claim 1, wherein the channel width/channel length ratio of the second transistor is four times the channel width/channel length ratio of the third transistor.

3. The driving circuit of claim 1, wherein the first transistor, the second transistor, the third transistor and the fourth transistor are all n-type amorphous silicon thin film transistors.

4. The driving circuit of claim 1, wherein the first voltage is a negative voltage.

5. The driving circuit of claim 1, wherein the first voltage is a ground potential.

6. The driving circuit of claim 1, wherein the second voltage is a positive voltage.

7. The driving circuit of claim 1, wherein the third voltage is a positive voltage.

8. The driving circuit of claim 1, wherein the negative terminal of the light-emitting device is coupled to a fourth voltage line.

9. The driving circuit of claim 8, wherein the fourth voltage is a negative voltage.

10. The driving circuit of claim 8, wherein the fourth voltage is a ground potential.

11. The driving circuit of claim 1, wherein the light-emitting device includes an organic light-emitting diode.

12. The driving circuit of claim 1, wherein the light-emitting device includes a polymeric light-emitting diode.

13. A display having a plurality of pixels with each pixel comprising:

a first transistor having a drain terminal, a gate terminal and a source terminal, wherein the drain terminal of the first transistor is coupled to an inverted data voltage line and the gate terminal of the first transistor is coupled to a scanning voltage line;

a capacitor having a first terminal and a second terminal, wherein the first terminal of the capacitor is coupled to the source terminal of the first transistor and the second terminal of the capacitor is coupled to a first voltage line;

a second transistor having a drain terminal, a gate terminal and a source terminal, wherein the gate terminal of the second transistor is coupled to the source terminal of the first transistor and the first terminal of the capacitor, and the source terminal of the second transistor is coupled to the first voltage line;

a third transistor having a drain terminal, a gate terminal and a source terminal, wherein the drain terminal of the third transistor is coupled to the gate terminal of the third transistor and a second voltage line, and the source terminal of the third transistor is coupled to the drain terminal of the second transistor;

a fourth transistor having a drain terminal, a gate terminal and a source terminal, wherein the drain terminal of the fourth transistor is coupled to a third voltage line, the gate terminal of the fourth terminal is coupled to the drain terminal of the second transistor and the source terminal of the third transistor; and a light-emitting device having a positive terminal and a negative terminal, wherein the positive terminal of the light-emitting device is coupled to the source terminal of the fourth transistor and the negative terminal of the light-emitting device is coupled to a fourth voltage line.

14. The display of claim 13, wherein the channel width/channel length ratio of the second transistor is four times the channel width/channel length ratio of the third transistor.

15. The display of claim 13, wherein the first transistor, the second transistor, the third transistor and the fourth transistor are all n-type amorphous silicon thin film transistors.

16. The display of claim 13, wherein the first voltage is a negative voltage.

17. The display of claim 13, wherein the first voltage is a ground potential.

18. The display of claim 13, wherein the second voltage is a positive voltage.

19. The display of claim 13, wherein the third voltage is a positive voltage.

20. The display of claim 13, wherein the fourth voltage is a negative voltage.

21. The display of claim 13, wherein the fourth voltage is a ground potential.

22. The display of claim 13, wherein the light-emitting device includes an organic light-emitting diode.

23. The display of claim 13, wherein the light-emitting device includes a polymeric light-emitting diode.

* * * * *